United States Patent [19]

Liang et al.

[11] Patent Number: 4,549,615

[45] Date of Patent: Oct. 29, 1985

[54] SINGLE-PASS NOTCHING AND DRILLING TOOL AND METHOD OF DRILLING A BLAST ROLE THEREWITH

[75] Inventors: Dah-Ben Liang, Greensburg; Robert S. Gulibon, Stahlstown, both of Pa.

[73] Assignee: Kennametal Inc., Latrobe, Pa.

[21] Appl. No.: 397,423

[22] Filed: Jul. 12, 1982

[51] Int. Cl.[4] ..... E21B 10/38; E21B 10/40

[52] U.S. Cl. ..... 175/389; 175/417

[58] Field of Search ..... 175/57, 325, 326, 389, 175/393, 410, 416, 417, 418, 390, 406, 385, 386, 407, 415; 299/15, 94

[56] References Cited

U.S. PATENT DOCUMENTS

| | | | |
|---|---|---|---|
| 740,906 | 10/1903 | Owen | 175/382 |
| 1,943,879 | 1/1934 | Rea | 175/393 |
| 2,938,709 | 5/1960 | Curtis | 175/390 |
| 3,227,230 | 1/1966 | Lagerstrom | 175/389 X |
| 4,294,319 | 10/1981 | Guergen | 175/389 |
| 4,361,197 | 11/1982 | Hutzell | 175/389 |

FOREIGN PATENT DOCUMENTS

| | | | |
|---|---|---|---|
| 994775 | 6/1965 | United Kingdom | 175/407 |
| 1208127 | 10/1970 | United Kingdom | 175/406 |

*Primary Examiner*—Stephen J. Novosad
*Assistant Examiner*—David J. Bagnell
*Attorney, Agent, or Firm*—Lawrence R. Burns

[57] ABSTRACT

Disclosed is a single-pass notching and drilling tool. The tool comprises an adaptor having a first threaded end for coupling with a power source, an opposed second threaded end, an enlarged diameter portion adjacent to the first threaded end and having a first abutment face and a mediate portion adjacent to the first axial abutment face and adjacent to the second threaded end. There is also a drill portion joined to the second threaded end of the adaptor and having a second axial abutment face. The tool further comprises a notching tool comprising a body having a central bore rotatably engaging the mediate portion of the adaptor. The notching tool is freely rotatable about the mediate portion independent of the rotation of the adaptor. The axial movement of the notching tool is bounded by the first and second axial abutment faces. Disclosed also is a method of drilling a blast hole with the single-pass notching and drilling tool.

12 Claims, 5 Drawing Figures

SINGLE-PASS NOTCHING AND DRILLING TOOL AND METHOD OF DRILLING A BLAST ROLE THEREWITH

BACKGROUND OF THE INVENTION

This invention relates to the field of earthworking tools. More specifically, this invention relates to those tools most suitable for the formation of notched blast holes.

A well known process useful in blasting is fracture control. It has been found that when an explosive charge is detonated in a notched blast hole, the presence of the notches causes the rock to fracture at the tips of the notches. The line of fracture would then proceed for some distance. In this way, the explosive force is directed so that overbreak is avoided.

It would be desirable from an economic standpoint to drill and notch the blast hole in a single pass. One of the earliest tools of this type used for fracture control is shown in U.S. Pat. No. 740,906, to Owen.

It is, of course, necessary that the tool perform dependably. A tool that becomes lodged in a blast hole, whether through breakage or improper design, is difficult and costly to remove. Often, if the tool does become lodged in a blast hole, the tool is considered lost and a new blast hole is drilled.

A modern version of the single-pass drilling and notching tool is illustrated in Department of Transportation Report No. UMTA-MA-06-0100-79-14, entitled "Field Evaluation of Fracture Control in Tunnel Blasting," at Page 31. It is to be noted that the tool illustrated is a conceptual sketch only.

A similar single-pass drilling and notching tool developed by the University of Maryland is illustrated in "Proceedings of the 22nd U.S. Symposium on Rock Mechanics," at Page 229, held at the Massachusetts Institute of Technology, June 29 to July 2, 1981. So far, this tool has only been found to be suitable for use in soft coal deposits.

It would be desirable to have a single-pass drilling and notching tool suitable for use in hard rock as well as in soft rock.

It is an object of this invention to have a single-pass drilling and notching tool that is dependable in use.

It is a further object of this invention to have a single-pass drilling and notching tool that is economical to use.

It is a still further object of this invention to have a single-pass drilling and notching tool that is suitable for use in both hard and soft rock.

BRIEF SUMMARY OF THE INVENTION

According to the invention, disclosed is a single-pass notching and drilling tool. The tool comprises an adaptor having a first threaded end for coupling with a power source, an opposed second threaded end, an enlarged diameter portion adjacent to the first threaded end and having a first axial abutment face and a mediate portion adjacent to the first axial abutment face and adjacent to the second threaded end. There is a drill portion joined to the second threaded end of the adaptor and having a second axial abutment face.

The tool further comprises a notching tool comprising a body having a central bore rotatably engaging the mediate portion of the adaptor. The notching tool is freely rotatable about the mediate portion independent of the rotation of the adaptor. The axial movement of the notching tool is bounded by the first and second axial abutment faces.

Preferably, the drill portion comprises a drill bit. The drill bit threadedly engages the second end of the adaptor.

The notching tool has a rearward face and a forward face opposing respectively the first and second axial abutment faces. There is also a grooving wing extending radially outwardly from the body. The grooving wing comprises a recess formed longitudinally from the forward face rearwardly in the body and ending in a seat that is transverse to the longitudinal axis of the body.

The grooving wing further comprises a wear compact mounted on the seat and in the recess and extending radially outwardly from the pilot body.

The notching tool, apart from the single-pass notching and drilling tool, may be considered a separate article of commerce.

The outermost peripheral surface of the grooving wing, when viewed from the side, tapers inwardly and rearwardly of the body. Preferably, the outermost peripheral surface forms an included angle of approximately three degrees with the longitudinal axis of the body.

The grooving wing, when viewed in plan, tapers inwardly as it extends radially outwardly. The grooving wing, preferably, is V-shaped with the V opening in the direction of the body.

Most preferably, the wear compact is formed of a cemented hard metal carbide.

It is preferable that the V-shaped grooving wing define an included angle having a value of 45 to 100 degrees and, most preferably, the included angle is 60 to 90 degrees.

In another embodiment, the bore of the notching tool has a wall, and this bore wall has a recess.

Also disclosed according to the invention is a method of drilling a blast hole with a drill of the type having an adaptor, notching tool and drill bit. The method comprises rotatably engaging the adaptor and the notching tool, threadingly engaging the adaptor and the drill bit, and then coupling the adaptor, notching tool and drill bit to a power source. The final step of the method comprises operating the drill so that, as the drill bit drills a generally circular hole, the notching tool forms at least one radial notch extending outwardly from the outside diameter of the hole.

BRIEF DESCRIPTION OF THE DRAWINGS

The exact nature of the present invention will become more clearly apparent upon reference to the following detailed specification taken in connection with the accompanying drawings in which.

DETAILED DESCRIPTION OF THE INVENTION

Figure 1:
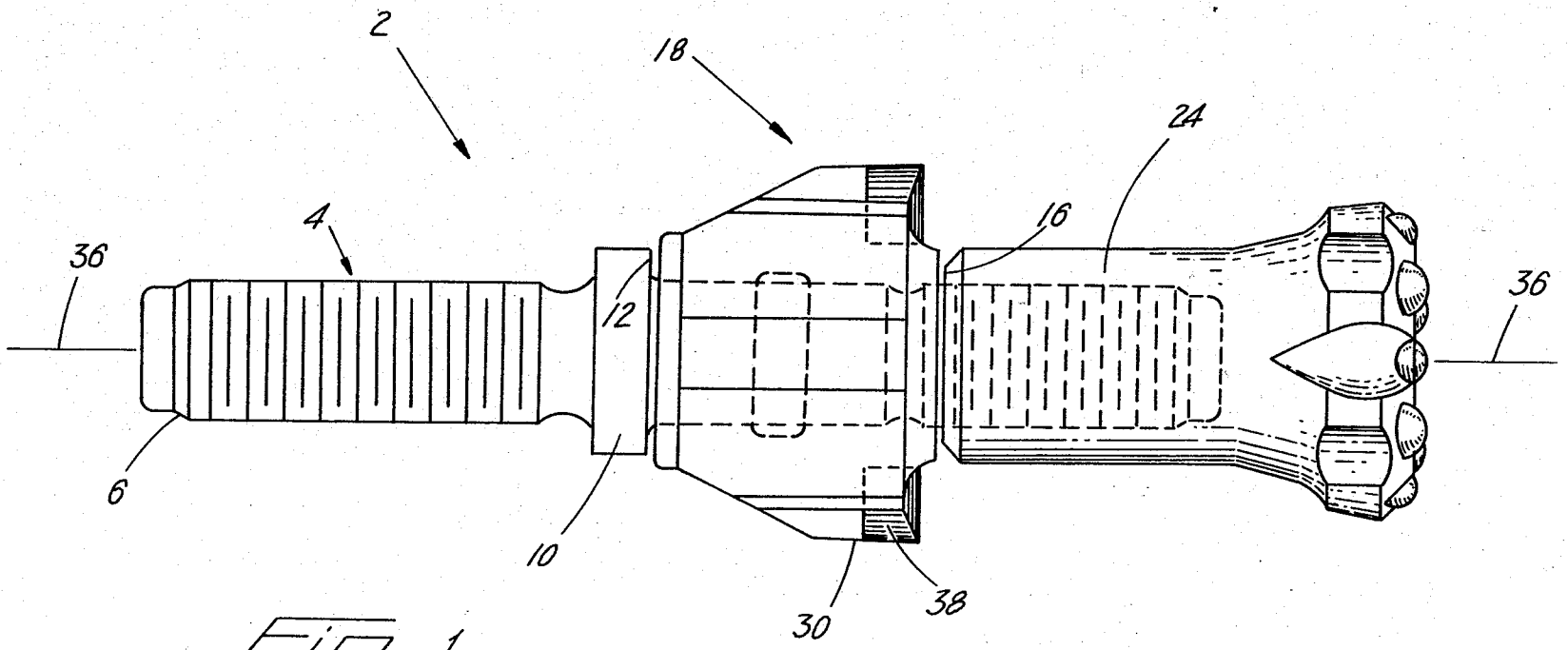
FIG. 1 is a side view of the single-pass notching and drilling tool according to the invention.
Figure 3:
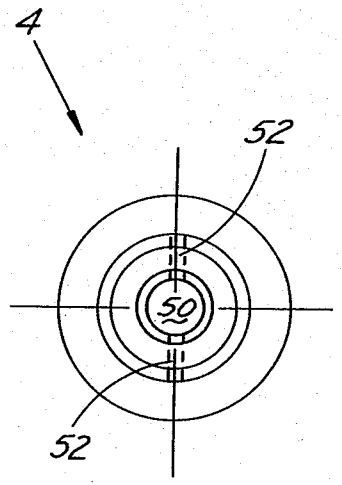
FIG. 3 is an end view of the adaptor.
Figure 2:
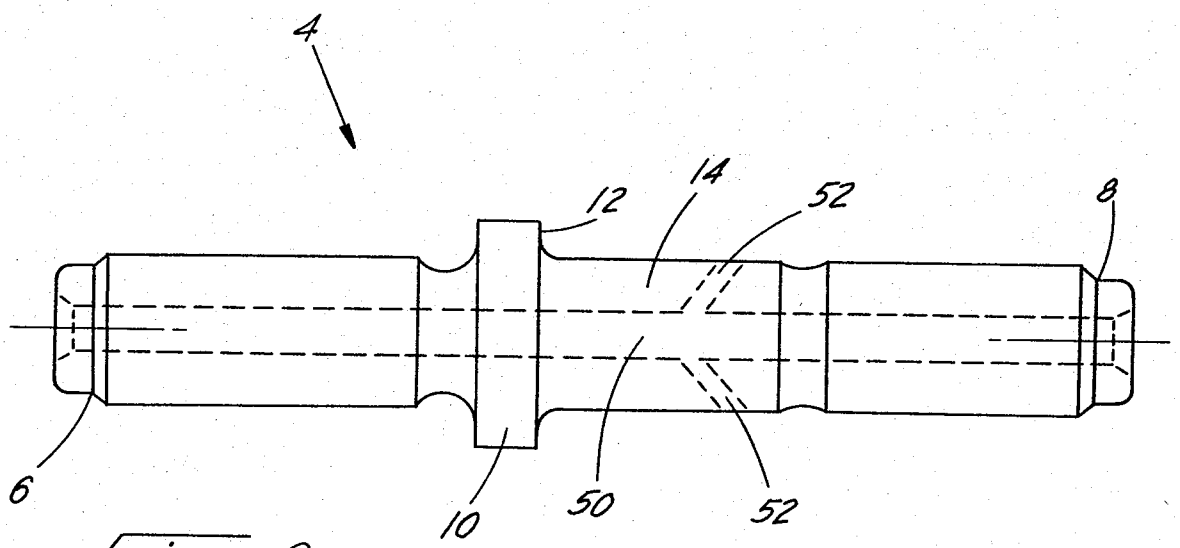
FIG. 2 is a side view of the adaptor.

Referring to the drawings somewhat more in detail, disclosed according to the invention is a single-pass notching and drilling tool 2, as shown in FIG. 1. The tool comprises an adaptor 4, as best seen in FIGS. 2 and 3. The adaptor has a first threaded end 6 for coupling with a power source (not shown), an opposed second threaded end 8, an enlarged diameter portion 10 adjacent to the first threaded end 6 and having a first axial abutment face 12. The adaptor also has a mediate portion 14 adjacent to the first axial abutment face 12 and also adjacent to the second threaded end 8.

The tool also comprises a drill portion joined to the second threaded end of the adaptor and having a second axial abutment face 16.

Figure 4:
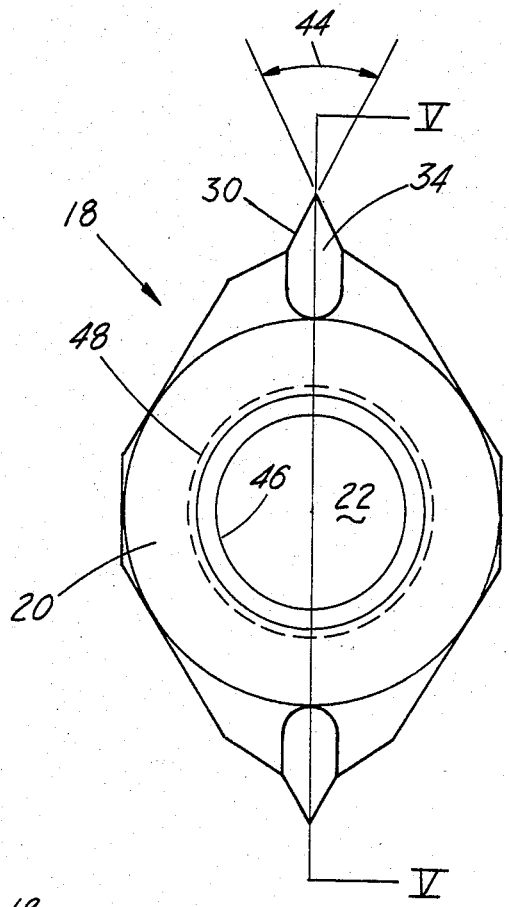
FIG. 4 is an end view of the notching tool.
Figure 5:
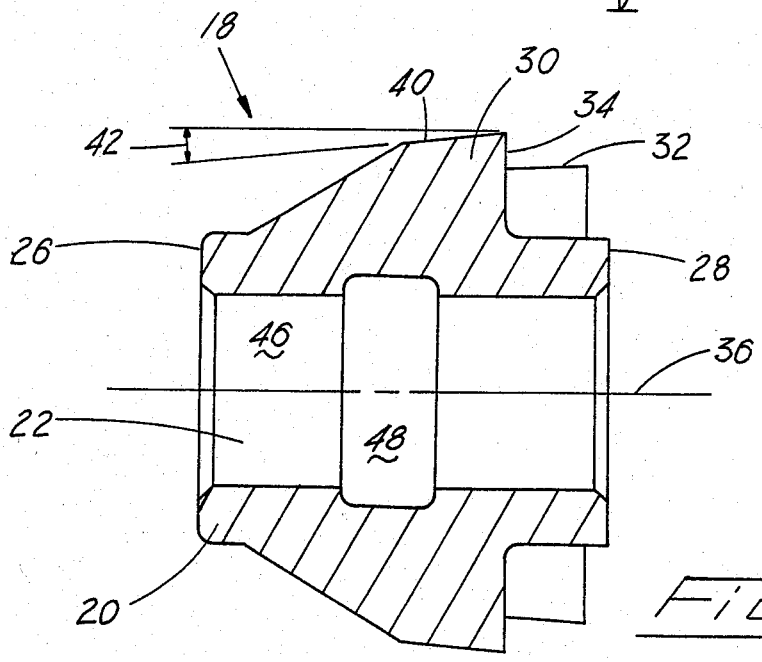
FIG. 5 is a sectional view of the notching tool of FIG. 4 along line V—V.

Finally, the drill comprises a notching tool 18 as best shown in FIGS. 4 and 5. The notching tool comprises a body 20 having a central bore 22 rotatably engaging the mediate portion 14 of the adaptor 4. The notching tool is freely rotatable about the mediate portion independent of the rotation of the adaptor. The axial movement of the notching tool is bounded by the first and second axial abutment faces 12 and 16, respectively.

Preferably, the drill portion comprises a drill bit 24. The drill bit threadedly engages the second end 8 of the adaptor 4. The drill bit shown in FIG. 1 is a button bit, but other drill bits which are well known in the art, such as the X bit, will work as well to achieve the objects of the invention. Depending on the drill bit selected, the drill will work by a rotary or a rotary percussive action.

In the operation of the single-pass notching and drilling tool with the button bit as shown in FIG. 1, the drill bit will work by a rotary percussive action so as to cause a generally circular hole to be formed. The notching tool following behind the drill bit will cause at least one notch to be formed in the wall of the hole. The notching tool is freely rotatable about the mediate portion of the adaptor and is independent of the rotation of the adaptor. Therefore, once the notch begins to form at the top of the blast hole, a portion of the notching tool will ride in the notch formed so that the notching tool will not rotate when the drill bit rotates. However, the percussive action will be transmitted to the notching tool so that a notch is continually being formed as the blast hole is being formed. As is shown in FIG. 1, and as is usually the case, the notching tool will cause oppositely extending notches to be formed in the wall. The single-pass notching and drilling tool will then be withdrawn from the hole and explosives will be inserted in the hole. When the explosives are detonated, the rock will preferentially fracture at the notches formed by the single-pass notching and drilling tool.

As best shown in FIGS. 4 and 5, the notching tool 18 has a rearward face 26 and a forward face 28 opposing respectively the first and second axial abutment faces. While the notching tool is forming the notches, that is, during the downward travel of the tool, the rearward face will abut the first axial abutment face. Upon withdrawal of the notching tool from the hole, the forward face will abut the second axial abutment face.

There is also a grooving wing 30 extending radially outwardly from the body. The grooving wing comprises a recess 32 formed longitudinally from the forward face rearwardly in the body and ending in a seat 34 that is transverse to the longitudinal axis 36 of the body. The grooving wing also has a wear compact 38 (not shown in FIGS. 4 and 5) mounted on the seat and in the recess and extending radially outwardly from the body. To achieve the objects of the invention, at least one grooving wing is required; however, there will be, preferably, two or more grooving wings.

The outermost peripheral surfaces 40 of the grooving wing 30, when viewed from the side, as shown in FIG. 5, taper inwardly and rearwardly of the body. Preferably, the outermost peripheral surface 40 forms an included angle 42 of approximately three degrees with the longitudinal axis 36 of the body.

The grooving wing 30, when viewed in plan, as shown in FIG. 4, tapers inwardly as it extends outwardly. Preferably, the grooving wing 30 is V-shaped with the V opening in the direction of the body.

More preferably, the V-shaped grooving wing defines an included angle 44 having a value of 45 to 100 degrees. Most preferably, this included angle is 60 to 90 degrees.

In a most preferred embodiment, the wear compact 38 is formed of a cemented hard metal carbide.

In another preferred embodiment, the bore 22 of the notching tool has a wall 46, and this bore wall has a recess 48.

As best seen in FIGS. 2 and 3, there will be a central passage 50 in the adaptor which in turn connects with several smaller passageways 5 (not shown) in the drill bit. This central passage is for the purpose of utilizing a flushing fluid to flush the crushed rock out of the hole. There will also be two side passageways 52 which also aid in the flushing process but may also act to provide a lubricant or coolant for the notching tool.

Also disclosed according to the invention is a notching tool 18 as a separate article of commerce. The notching tool comprises a body 20 having a central bore 22, a forward face 28, a rearward face 26 and a grooving wing 30 extending radially outwardly from the body. The grooving wing comprises a recess 32 formed longitudinally from the forward face, rearwardly in the body and ending in a seat 34 that is transverse to the longitudinal axis 36 of the body. The grooving wing also comprises a wear compact 38 mounted on the seat in the recess and extending radially outwardly from the body.

The outermost peripheral surfaces 40 of the grooving wing 30, when viewed from the side, as shown in FIG. 5, taper inwardly and rearwardly of the body. Preferably, the outermost peripheral surface forms an included angle 42 of approximately three degrees with the longitudinal axis 36 of the body.

The grooving wing 30, when viewed in plan, as seen in FIG. 4, tapers inwardly as it extends radially outwardly. Preferably, the grooving wing is V-shaped with the V opening in the direction of the body. More preferably, the V-shaped grooving wing defines an included angle 44 having a value of 45 to 100 degrees and, most preferably, the included angle is 60 to 90 degrees.

In a preferred embodiment, the wear compact 38 is formed of a cemented hard metal carbide.

In a further preferred embodiment, the bore 22 of the notching tool has a wall 46, and this wall has a recess 48. This bore wall recess may serve two purposes. The first purpose may be to reduce the surface area in contact with the mediate portion, thereby reducing the amount of friction, and the heat subsequently generated therefrom, on the mediate portion. The second purpose of this recess may be to act as a reservoir for lubricating fluid.

According to the invention, there is also a method of drilling a blast hole with a drill of the type having an adaptor 4, a notching tool 18 and a drill bit 24. The method comprises rotatably engaging the adaptor and the notching tool, threadingly engaging the adaptor and the drill bit, and then coupling the adaptor, notching tool and drill bit to a power source, The method finally comprises operating the drill so that, as the drill bit drills a generally circular hole, the notching tool forms at least one radial notch extending outwardly from the outside diameter of the hole.

Modifications may be made within the scope of the appended claims.

What is claimed is:

1. A single-pass notching and drilling tool comprising: an adaptor having a first threaded end for coupling with a power source, an opposed second threaded end, an enlarged diameter portion adjacent to said first threaded end and having a first axial abutment face, and a mediate portion adjacent to said first axial abutment face and said second threaded end; a drill portion joined to said second threaded end of said adaptor and having a second axial abutment face; and a notching tool comprising a body having a central bore rotatably engaging said mediate portion of said adaptor, said notching tool freely rotatable about said mediate portion independent of the rotation of said adaptor, the axial movement of said notching tool bounded by said first and second axial abutment faces.

2. The notching and drilling tool of claim 1 wherein said drill portion comprises a drill bit, said drill bit threadingly engaging said second end of said adaptor.

3. The notching and drilling tool of claim 2 wherein said wear compact is formed of a cemented hard metal carbide.

4. The notching and drilling tool of claim 1 wherein said notching tool has a rearward face and a forward face opposing, respectively, said first and second axial abutment faces, and a grooving wing extending radially outwardly from said body, said grooving wing comprising a recess formed longitudinally from said forward face rearwardly in said body and ending in a seat that is transverse to the longitudinal axis of said body, and a wear compact mounted on said seat and in said recess and extending radially outwardly from said body.

5. The notching and drilling tool of claim 3 wherein the outermost peripheral surfaces of said grooving wing, when viewed from the side, taper inwardly and rearwardly of said body.

6. The notching and drilling tool of claim 5 wherein said grooving wing, when viewed in plan, tapers inwardly as it extends radially outwardly.

7. The notching and drilling tool of claim 6 wherein said grooving wing is V-shaped with the V opening in the direction of said body.

8. The notching and drilling tool of claim 7 in which said wear compact is formed of a cemented hard metal carbide.

9. The notching and drilling tool of claim 7 wherein said V-shaped grooving wing defines an included angle having a value of 45 to 100 degrees.

10. The notching and drilling tool of claim 9 wherein said included angle is 60 to 90 degrees.

11. The notching and drilling of claim 5 in which said outermost peripheral surface forms an included angle of approximately three degrees with the longitudinal axis of said body.

12. A single-pass notching and drilling tool comprising: an adaptor having a first threaded end for coupling with a power source, an opposed second threaded end, an enlarged diameter portion adjacent to said first threaded end and having a first axial abutment face, and a mediate portion adjacent to said first axial abutment face and said second threaded end; a drill portion joined to said second threaded end of said adaptor and having a second axial abutment face; and a notching tool comprising a body having a central bore wall rotatably engaging said mediate portion of said adaptor, said central bore wall having a recess formed therein, said notching tool freely rotatable about said mediate portion independent of the rotation of said adaptor, the axial movement of said notching tool bounded by said first and second axial abutment faces, said notching tool having a rearward face and a forward face opposing, respectively, said first and second axial abutment faces, and a grooving wing extending radially outwardly from said body, said grooving wing comprising a recess formed longitudinally from said forward face rearwardly in said body and ending in a seat that is transverse to the longitudinal axis of said body, and a wear compact mounted on said seat and in said recess and extending radially outwardly from said body, the outermost peripheral surfaces of said grooving wing, when viewed from the side, tapering inwardly and rearwardly of said body.

* * * * *